US009604233B2

(12) United States Patent
Yamauchi

(10) Patent No.: US 9,604,233 B2
(45) Date of Patent: Mar. 28, 2017

(54) ROTARY ATOMIZING HEAD TYPE COATING MACHINE

(71) Applicant: ABB K.K., Tokyo (JP)

(72) Inventor: Kuniharu Yamauchi, Nagakute (JP)

(73) Assignee: ABB K.K., Tokyo (JP)

( * ) Notice: Subject to any disclaimer, the term of this patent is extended or adjusted under 35 U.S.C. 154(b) by 0 days.

(21) Appl. No.: 14/784,059

(22) PCT Filed: Aug. 11, 2014

(86) PCT No.: PCT/JP2014/071199
§ 371 (c)(1),
(2) Date: Oct. 13, 2015

(87) PCT Pub. No.: WO2015/029763
PCT Pub. Date: Mar. 5, 2015

(65) Prior Publication Data

US 2016/0059248 A1 Mar. 3, 2016

(30) Foreign Application Priority Data

Aug. 26, 2013 (JP) ..... 2013-174423

(51) Int. Cl.
*B05B 3/10* (2006.01)
*B05B 5/04* (2006.01)
(Continued)

(52) U.S. Cl.
CPC ..... *B05B 3/1092* (2013.01); *B05B 3/1035* (2013.01); *B05B 5/0415* (2013.01);
(Continued)

(58) Field of Classification Search
CPC ... B05B 3/1007; B05B 3/1014; B05B 3/1035; B05B 3/1064; B05B 3/1092;
(Continued)

(56) References Cited

U.S. PATENT DOCUMENTS 5,685,495 A * 11/1997 Pham ..... B05B 3/1042 239/588
6,050,499 A * 4/2000 Takayama ..... B05B 15/025 239/105
(Continued)

FOREIGN PATENT DOCUMENTS

JP 58 92475 6/1983
JP 59 82564 U 6/1984
(Continued)

OTHER PUBLICATIONS

International Search Report Issued Nov. 11, 2014 in PCT/JP14/071199 Filed Aug. 11, 2014.

*Primary Examiner* — Darren W Gorman
(74) *Attorney, Agent, or Firm* — Oblon, McClelland, Maier & Neustadt, L.L.P.

(57) ABSTRACT

A shaping air ring (10) is configured of a body (11), a cover (13) and a nozzle (15). A tapered conical protrusion (17) is provided in a front end of the nozzle (15) to abut on the cover (13) in contact therewith without a clearance therebetween. Numerous inclined recessed grooves (20) are provided on a forward tapered surfaces (17C) of the conical protrusion (17) over the entire periphery. Further, a first shaping air ejecting hole (23) is formed between each of the inclined recessed grooves (20) and an inner peripheral surface (13B2) of the cover (13) to eject shaping air toward a releasing edge (9E) of a rotary atomizing head (9). Second shaping air ejecting holes (24) are provided on an inner peripheral surface (16A) of the nozzle (15) to eject shaping air along an outer peripheral surface (9C) of the rotary atomizing head (9).

10 Claims, 9 Drawing Sheets

(51) Int. Cl.
*B05B 15/04* (2006.01)
*B05B 5/043* (2006.01)

(52) U.S. Cl.
CPC ..... *B05B 5/0426* (2013.01); *B05B 15/0431* (2013.01); *B05B 3/1064* (2013.01); *B05B 5/043* (2013.01)

(58) Field of Classification Search
CPC ..... B05B 5/0415; B05B 5/0426; B05B 5/043; B05B 15/0431
See application file for complete search history.

(56) References Cited

U.S. PATENT DOCUMENTS

| | | | | |
|---|---|---|---|---|
| 6,053,428 | A * | 4/2000 | Van Der Steur | B05B 3/1014 239/112 |
| 2009/0071397 | A1* | 3/2009 | Yasuda | B05B 3/1014 118/300 |
| 2011/0210180 | A1* | 9/2011 | Perinet | B05B 3/1092 239/1 |

FOREIGN PATENT DOCUMENTS

| | | |
|---|---|---|
| JP | 4 22451 | 1/1992 |
| JP | 8 84941 | 4/1996 |
| JP | 2003 225592 | 8/2003 |
| JP | 2005 34703 | 2/2005 |
| JP | 2012 40498 | 3/2012 |

* cited by examiner

ROTARY ATOMIZING HEAD TYPE COATING MACHINE

TECHNICAL FIELD

The present invention relates to a rotary atomizing head type coating machine provided with a shaping air ring that ejects shaping air to adjust a spray pattern of paint particles sprayed from a rotary atomizing head, for example.

BACKGROUND ART

In general, in a case of coating vehicle bodies of automobiles, articles of furniture, electrical appliances, and the like with paint, a rotary atomizing head type coating machine that is excellent in a coating efficiency and coating finish of paint is used. An example of the rotary atomizing head type coating machine includes an electrostatic coating machine that applies high voltages to paint to be supplied to a rotary atomizing head. In this example, paint particles charged with the high voltage can fly along an electrical line of force formed between a coated object and the rotary atomizing head, being efficiently applied on the coated object.

This rotary atomizing head type coating machine is configured of an air motor that uses compressed air as a power source, a hollow rotational shaft that is rotatably supported by the air motor and a front end of which protrudes to a front side from the air motor, a feed tube that extends to the front end of the rotational shaft through the rotational shaft to supply the paint, a rotary atomizing head that is mounted to the front end of the rotational shaft and is provided with an outer peripheral surface expanding in a cup shape to a front side, an inner peripheral surface for dispersing the paint supplied from the feed tube and a releasing edge positioned at a front end side to release the paint, and a shaping air ring that is disposed on the outer periphery of the rotary atomizing head such that a front end thereof is positioned closer to the backward than the releasing edge of the rotary atomizing head.

The shaping air ring has first shaping air ejecting holes that eject shaping air toward the releasing edge of the rotary atomizing head and second shaping air ejecting holes that eject shaping air along an outer peripheral surface of the rotary atomizing head.

The shaping air ring ejects the shaping air from the first and second shaping air ejecting holes respectively to micronize the paint sprayed from the releasing edge of the rotary atomizing head, while adjusting a spray pattern of paint particles to a desired size and shape. Further, the shaping air ejecting hole is inclined to a direction reverse to a rotational direction of the rotary atomizing head. Therefore, the shaping air ejected from the shaping air ejecting hole can collide squarely with liquids of the paint flying in a tangential direction from the rotary atomizing head to efficiently micronize the paint. In addition to the above, speeding up a flow velocity of the shaping air accelerates the micronization of the paint (Patent Document 1).

Here, an example of the method of speeding up the flow velocity of the shaping air includes a method of reducing a diameter of the shaping air ejecting hole to be small to increase the ejecting holes in number. This method can accelerate the micronization of the paint to finely control the spray pattern. However, since an advanced processing technique is required for microscopic hole drilling, in a case of reducing the diameter of the shaping air ejecting hole to be small and increasing the ejecting holes in number, manufacturing costs of the shaping air ring are increased. Further, in a case of increasing the shaping air ejecting holes in number, since a consumption amount of compressed air increases, an air compressor as a supply source of the compressed air is required to largely increase in size, leading to a problem of an increase in equipment cost.

In addition, a negative pressure region is generated in the surroundings of the shaping air ejecting hole in the shaping air ring due to the ejection of the shaping air having a fast flow velocity. As a result, since a part of the sprayed paint particles is pulled to the negative pressure region to be gradually attached to the front end of the shaping air ring, a periodical cleaning work is required to maintain coating quality of the shaping air ring. In this cleaning work, the shaping air ejecting holes formed as microscopic holes in addition to a front end part of the shaping air ring are required to be cleaned one by one, leading to necessity of lots of labors for the cleaning work to increase running costs.

It should be noted that the shaping air ring is generally formed of a material that is light in weight and excellent in workability, such as an aluminum alloy, and a surface thereof is subjected to corrosion resistance plate processing. Accordingly, an ultrasound bath that is effective in washing precision components cannot be currently used for avoiding separation of the plate.

On the other hand, there is an example of a rotary atomizing head type coating machine using another conventional technology, in which a shaping air ring is configured of an annular air nozzle and an annular cap that is disposed on an outer peripheral side of the air nozzle. According to this shaping air ring, numerous spiral grooves are disposed on an outer peripheral surface of the air nozzle in a position deeper than a front end of the shaping air ring, and outer peripheral sides of these spiral grooves are covered with an inner peripheral surface of the cap. Therefore, numerous shaping air ejecting holes that eject the shaping air are formed between each of the spiral grooves and the inner peripheral surface of the cap. In this case, not unworkable hole drilling but easy-to-work grooving can be used for forming each of the shaping air ejecting holes (Patent Document 2).

PRIOR ART DOCUMENT

Patent Document

Patent Document 1: Japanese Patent Laid-Open No. Hei8-84941A

Patent Document 2: Japanese Patent Laid-Open No. Sho58-92475A

SUMMARY OF THE INVENTION

Incidentally, the rotary atomizing head type coating machine according to Patent Document 2 is provided with an annular ejecting chamber that is formed between the air nozzle and the cap to be positioned ahead of each of the shaping air ejecting holes. Therefore, the shaping air ejected from each of the shaping air ejecting holes flows into the ejecting chamber once, and is then ejected toward the periphery of the rotary atomizing head.

Accordingly, even when the shaping air is ejected in a swirl flow from the shaping air ejecting hole, the swirl flow is eased up during the passing of the shaping air through the ejecting chamber to weaken the directivity of the shaping air. Therefore, the structure of the rotary atomizing head type coating machine according to Patent Document 2 has a problem that the paint cannot be micronized and controllability of the spray pattern also deteriorates.

The present invention is made in view of the foregoing problems in the conventional art, and an object of the present invention is to provide a rotary atomizing head type coating machine that even in a case where each of shaping air ejecting holes is formed as a microscopic hole that is easy to wash, shaping air ejected from the shaping air ejecting hole can micronize paint to improve controllability of a spray pattern of paint particles.

(1) A rotary atomizing head type coating machine according to the present invention comprising: an air motor that uses compressed air as a power source; a hollow rotational shaft that is rotatably supported by the air motor and a front end of which protrudes to a front side from the air motor; a feed tube that extends to the front end of the rotational shaft through the rotational shaft to supply paint; a rotary atomizing head that is mounted to the front end of the rotational shaft and includes an outer peripheral surface expanding in a cup shape to a front side, an inner peripheral surface for dispersing the paint supplied from the feed tube, and a releasing edge positioned in a front end to release the paint; and a shaping air ring that is disposed on the outer periphery of the rotary atomizing head such that a front end thereof is positioned closer to the backward than the releasing edge of the rotary atomizing head, the shaping air ring including first shaping air ejecting holes that eject shaping air toward the releasing edge of the rotary atomizing head and second shaping air ejecting holes that eject shaping air along the outer peripheral surface of the rotary atomizing head.

In order to solve the above-described problems, a characteristic of a configuration adopted by the present invention is that the shaping air ring includes: a body that is formed in a tubular shape and is mounted to a front side position of the air motor; a conical cover that is provided on an outer peripheral side of the body and a diameter of which is reduced to be smaller toward a front end thereof; and a nozzle that is provided on an inner peripheral side of the body and a front end of which extends to the same position with the front end of the cover, wherein the nozzle has the front end provided with a tapered conical protrusion that abuts on an inner peripheral surface of the cover in contact therewith without a clearance, the conical protrusion has a forward tapered surface provided with numerous inclined recessed grooves over its entire periphery that are inclined in a direction reverse to a rotational direction of the rotary atomizing head, the first shaping air ejecting hole is formed between each of the inclined recessed grooves and the inner peripheral surface of the cover, and the second shaping air ejecting hole is provided on an inner peripheral surface of the nozzle.

With this arrangement, the first shaping air ejecting hole can be formed between each of the inclined recessed grooves provided in the conical protrusion and the inner peripheral surface of the cover. In this case, the first shaping air ejecting hole can be formed using not unworkable hole drilling but easy-to-work grooving. Therefore, the first shaping air ejecting hole having a small passage area can be formed in an easy work. Accordingly, it is possible to perform a reduction in use amount of the compressed air due to making the small passage area of the shaping air ejecting hole smaller and simplification of the cleaning work due to the grooved shaping air ejecting hole.

In addition, since the conical protrusion of the nozzle at the front end is disposed in the same position with the front end of the cover, the first shaping air ejecting holes numerously provided can be respectively opened independently on the front end surface of the shaping air ring. Therefore, the shaping air ejected as the swirl flow from each of the first shaping air ejecting holes can be splashed on paint particles sprayed from the releasing edge of the rotary atomizing head in a state of sufficiently maintaining the swirl flow (directivity of a swirl direction).

As a result, the first shaping air ejecting hole can be formed as a microscopic hole that is easy to wash by using the inclined recessed groove. In addition thereto, since the swirl direction of the shaping air holds the directivity, it is possible to accelerate the micronization of the paint particles and improve the controllability of the spray pattern. On the other hand, since the second shaping air ejecting hole is provided on the inner peripheral surface of the nozzle, complex shaping air can be formed in cooperation with the first shaping air ejecting hole. Therefore, the paint can be furthermore micronized to improve the controllability of the spray pattern.

(2) According to the present invention, the inclined recessed grooves respectively are formed of numerous protruding walls provided to protrude by intervals on an entire periphery of the conical protrusion to be inclined in a direction reverse to the rotational direction of the rotary atomizing head, and numerous groove bottom faces formed between a pair of opposing side wall surfaces of the protruding walls respectively, and each of the side wall surfaces forming each of the protruding walls is provided with a chamfered part that is positioned in a front end of the conical protrusion to further increase an inclination angle of each of the side wall surfaces.

With this arrangement, since each of the side wall surfaces is provided with the chamfered part that is positioned in the front end of the conical protrusion, the inclination angle of each of the side wall surfaces can be further increased. As a result, the first shaping air can accurately apply to the paint particles released in a tangential direction from the releasing edge of the rotary atomizing head to largely widen the spray pattern of the paint.

(3) According to the present invention, the second shaping air ejecting hole of the shaping air ring is formed to be inclined radially inside toward a front end of the conical protrusion, and the second shaping air ejecting hole is opened to the inner peripheral surface of the nozzle as an elongated hole having a length dimension long in an axis line direction of the rotational shaft.

With this arrangement, the second shaping air ejecting hole inclined radially inside toward the front end of the conical protrusion can eject the second shaping air toward the outer peripheral surface near the releasing edge of the rotary atomizing head. Further, since the second shaping air ejecting hole is opened to the inner peripheral surface of the nozzle as the elongated hole having the length dimension long in the axis line direction of the rotational shaft, a front end surface of the shaping air ring can be formed such that a radial width dimension thereof is made small. In addition, the second shaping air ejecting hole opened as the elongated hole can be easily washed since wash liquids are easily poured therein.

(4) According to the present invention, the first shaping air ejecting hole and the second shaping air ejecting hole are disposed to be radially closer to each other toward a front end of the shaping air ring, and a front end surface of the shaping air ring composed of a front end of the cover and a front end of the conical protrusion is formed as an edge-shaped front end surface having an area made as small as possible.

With this arrangement, in the front end of the shaping air ring that is the closest to the sprayed paint, a flat surface thereof to which the paint can attach can be made as small as possible. As a result, the attachment of the paint to the front end of the shaping air ring can be prevented to cut down on washing frequency and washing hours.

(5) According to the present invention, the inclined recessed grooves respectively are formed of numerous protruding walls provided to protrude by intervals on an entire periphery of the conical protrusion to be inclined in a direction reverse to the rotational direction of the rotary atomizing head, and numerous groove bottom faces formed between a pair of opposing side wall surfaces of the protruding walls respectively, and each of the inclined recessed grooves is provided with a corner part that is provided between each of the groove bottom faces and each of the side wall surfaces of the protruding walls respectively to be formed in an arc shape.

With this arrangement, stress concentration on the groove bottom face of the inclined recessed groove can be avoided to increase a mechanical strength and reduce manufacturing costs. In addition, even when the paint enters into the inclined recessed groove of the nozzle to cause pigment, metallic powder and the like contained in the arc-shaped corner part to attach thereto, these can be easily washed to complete the washing work in a short time.

(6) According to the present invention, an inclination angle of each of the inclined recessed grooves is set to 50 to 80 degrees to an axis line of the rotational shaft. Therefore, the first shaping air ejecting hole can eject the shaping air at the inclination angle of 50 to 80 degrees. In this case, since the first shaping air ejecting hole is opened to be inclined in a direction reverse to the rotational direction of the rotary atomizing head, the first shaping air ejecting hole can cause the shaping air to collide squarely with liquids of the paint flying in a tangential direction from the rotary atomizing head to micronize the paint.

(7) According to the present invention, an inclination angle of the second shaping air ejecting hole is set to 1 to 12 degrees to an axis line of the rotational shaft. Therefore, the second shaping air ejecting hole can eject the shaping air at the inclination angle of 1 to 12 degrees. Accordingly, the shaping air ejected at this inclination angle can be supplied to the releasing edge along the outer peripheral surface of the rotary atomizing head to disperse the paint released from the releasing edge.

(8) According to the present invention, a length dimension of the chamfered part of each of the protruding walls is set to 0.3 to 0.8 mm. Therefore, the inclination angle of the first shaping air ejecting hole can be made larger.

(9) According to the present invention, a radial dimension of the edge-shaped front end surface in the shaping air ring is set to 1 to 6 mm. Therefore, an annular area formed on the front end surface of the shaping air ring can be made as small as possible. Accordingly, since the front end surface positioned in a negative pressure region is made extremely small, the paint is difficult to attach to the front end surface, and even when the paint attaches thereto, the attached paint can be easily washed.

(10) According, to the present invention, a height dimension of each of the side wall surfaces in front ends of the protruding walls respectively is set to 0.4 to 0.6 mm, and a width dimension of each of the groove bottom faces is set to 0.6 to 1.2 mm. Therefore, the first shaping air ejecting hole can be formed as a microscopic hole that is easily processed and washed, and is small in air consumption amount.

MODE FOR CARRYING OUT THE INVENTION

Hereinafter, a rotary atomizing head type coating machine according to an embodiment of the present invention will be in detail explained with reference to FIG. 1 to FIG. 9. Here, rotary atomizing head type coating machines include two types of coating machines, that is, an electrostatic coating machine that applies high voltages to spraying paint for coating and a non-electrostatic coating machine that does not apply high voltages to paint for coating. The present embodiment as hereinafter described will be explained by taking a rotary atomizing head type coating machine configured as a direct charging type of electrostatic coating machine that applies high voltages directly to paint, as an example.

Figure 1:
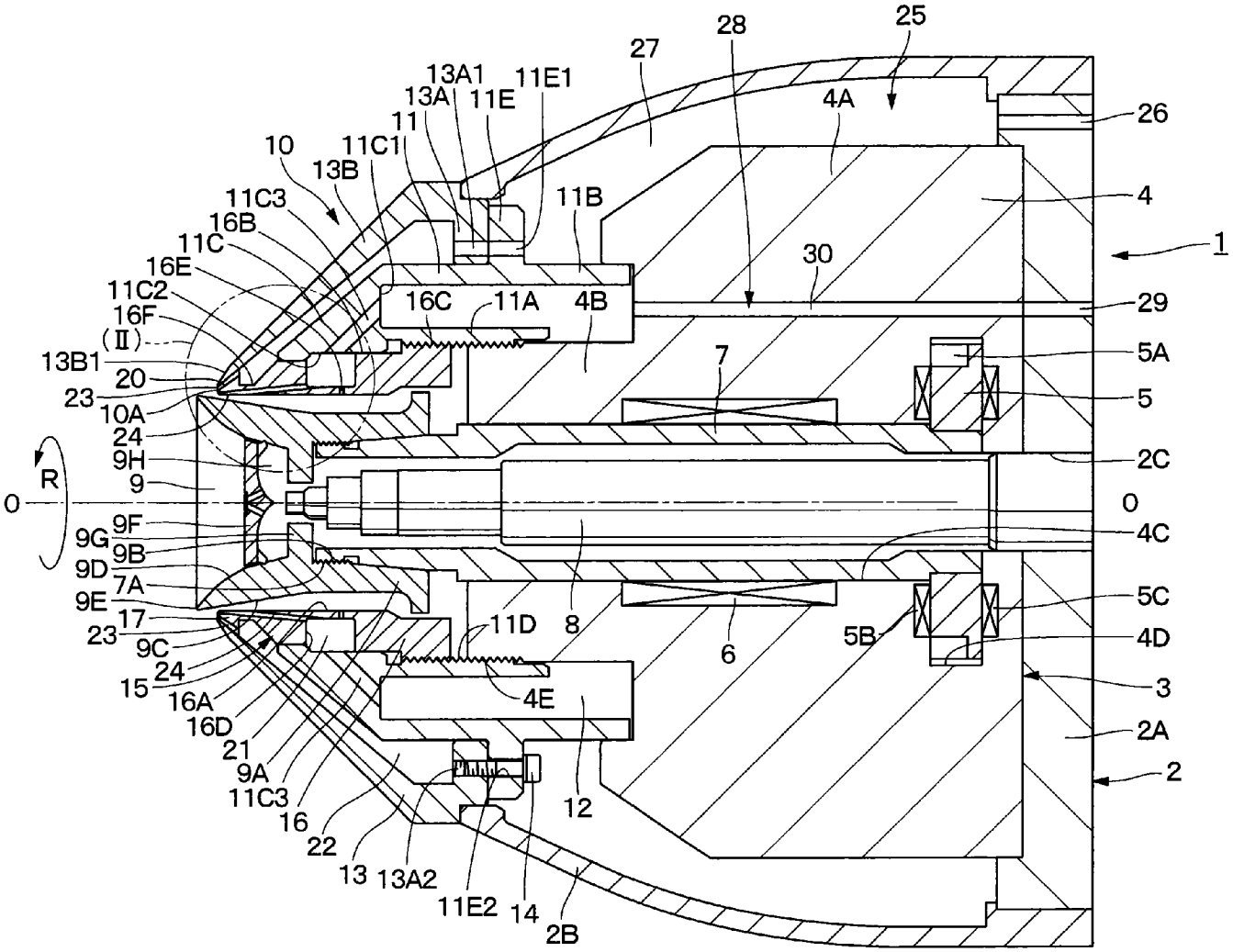
FIG. 1 is a longitudinal sectional view showing a rotary atomizing head type coating machine according to an embodiment in the present invention.

In FIG. 1, designated at 1 is a rotary atomizing head type coating machine according to the present embodiment. The rotary atomizing head type coating machine 1 is formed as a direct charging type of electrostatic coating machine that directly applies high voltages to paint by a high-voltage generator (not shown). The rotary atomizing head type coating machine 1 is mounted to, for example, a front end of an arm in a coating robot, a reciprocator or the like (not shown). The rotary atomizing head type coating machine 1 includes a housing 2, an air motor 3, a rotational shaft 7, a feed tube 8, a rotary atomizing head 9, and a shaping air ring 10.

Denoted at 2 is the housing of the rotary atomizing head type coating machine 1. The housing 2 is provided with a main housing body 2A that is positioned on the rear side and is formed in a disk shape, and a cover tube 2B that extends from an outer peripheral side to a front side of the main housing body 2A. The main housing body 2A has a rear surface side that is mounted to the front end of the arm as described above. On the other hand, the air motor 3 to be described later is mounted to a front surface side of the main housing body 2A. Further, an insertion hole 2C in which a base end of the feed tube 8 to be described later is fitted is provided in an axis center position (axis line O-O of the rotational shaft 7 to be described later) of the main housing body 2A.

The air motor 3 is provided in the housing 2 to be coaxial therewith (axis line O-O), and the air motor 3 rotates the rotational shaft 7 and the rotary atomizing head 9, which will be described later, at high speeds of, for example, 3000 to 15000 rpm by using compressed air as a power source. The air motor 3 is formed of a stepped cylindrical motor case 4 that is mounted in a front side of the main housing body 2A, a turbine 5 that is positioned closer to a rear side of the motor case 4 and is rotatably accommodated in a turbine accommodating chamber 4D to be described later through front and rear thrust air bearings 5B, 5C, and a radial air bearing 6 that is provided in the motor case 4 and rotatably supports the rotational shaft 7.

The motor case 4 of the air motor 3 is formed of a tubular body having an axis line O-O of the rotational shaft 7 as a center line. The motor case 4 is formed in a stepped tubular shape with a large diameter tube 4A, having a large diameter, that is mounted in the front side of the main housing body 2A of the housing 2 and a small diameter tube 4B, having a small diameter, that protrude from a front end to a front side of the large diameter tube 4A. A shaft insertion hole 4C is provided in an axis center position of the large diameter tube 4A and the small diameter tube 4B for insertion of the rotational shaft 7, and the turbine accommodating chamber 4D for accommodating the turbine 5 therein is formed in the deep part (rear side) of the shaft insertion hole 4C. On the other hand, a male screw 4E is formed on an outer peripheral side of the small diameter tube 4B to be positioned in a front end thereof, and a female screw 11D of a body 11 in the shaping air ring 10 to be described later is threaded into the male screw 4E. Further, the large diameter tube 4A is provided with a motor case inner passage 30 to be described later.

The turbine 5 is formed of a disk body that expands in a flange shape from the base end of the rotational shaft 7, and is jointed to the rotational shaft 7 by means of welding or press abutment, or is formed integrally with the rotational shaft 7. An impeller 5A is provided on an outer peripheral side of the turbine 5 with a plurality of rotor blades that are continuously disposed in the circumferential direction. The turbine 5 can rotate the rotational shaft 7 at high speeds by spraying turbine air (compressed air) toward the impeller 5A. At this time, the turbine 5 is supported in a thrust direction by the thrust air bearings 5B, 5C.

The radial air bearing 6 is provided on an inner peripheral side of the large diameter tube 4A in the motor case 4 to have an inner peripheral surface identical to that of the shaft insertion hole 4C. The radial air bearing 6 sprays supplied bearing air (compressed air) on the outer peripheral surface of the rotational shaft 7 to form an air layer between the radial air bearing 6 and the outer peripheral surface of the rotational shaft 7, thus rotatably supporting the rotational shaft 7 with the air layer.

The rotational shaft 7 is formed as a hollow tubular body that is rotatably supported on the air motor 3 through the radial air bearing 6. The rotational shaft 7 is disposed to axially extend centered at the axis line O-O in the shaft insertion hole 4C of the motor case 4. The base end (rear end) of the rotational shaft 7 is mounted to be integral with a central part of the turbine 5, and a front end thereof protrudes forward from the motor case 4. A male screw 7A is formed in the diameter-reduced front end of the rotational shaft 7 to mount the rotary atomizing head 9 to be described later thereon.

The feed tube 8 is provided to extend through the rotational shaft 7 to the front end of the rotational shaft 7, and a front end of the feed tube 8 protrudes from the front end of the rotational shaft 7 to extend into the rotary atomizing head 9. A base end of the feed tube 8 is inserted in an insertion hole 2C of the housing 2 to be fitted therein. The feed tube 8 is formed of, for example, a tubular body of a double structure, having a central passage serving as a paint passage and an outside annular passage serving as a wash fluid passage (none of them are shown). The paint passage is connected to a paint supply source such as a color changing valve device, and the wash fluid passage is connected to a wash fluid supply source (none of them are shown).

The feed tube 8 supplies paint to the rotary atomizing head 9 from the paint passage at the coating work. On the other hand, at the washing work, the feed tube 8 can supply wash fluid such as thinner or air from the wash fluid passage to the rotary atomizing head 9.

The rotary atomizing head 9 is mounted on the front end of the rotational shaft 7. The rotary atomizing head 9 is formed in a cup shape to expand in diameter from the rear side to the front side, and is rotated at high speeds in a direction of an arrow R (refer to FIG. 1, FIG. 5 and FIG. 8) together with the rotational shaft 7 by the air motor 3 to spray paint supplied from the feed tube 8. A base end of the rotary atomizing head 9 is configured as a cylindrical mounting part 9A, and a female screw 9B threaded into the male screw 7A of the rotational shaft 7 is formed in the deep part of the mounting part 9A. Here, the rotary atomizing head 9 having a diameter dimension of 30 mm at the releasing edge 9E is used as an example.

The rotary atomizing head 9 is provided with an outer peripheral surface 9C and an inner peripheral surface 9D in a front side of the mounting part 9A in the rotary atomizing head 9, the outer peripheral surface 9C expanding in a cup shape toward the front side, and the inner peripheral surface 9D expanding in a trumpet shape to the front side to be formed as a paint thin film surface that thins and disperses the paint supplied from the feed tube 8. A front end position of the inner peripheral surface 9D is configured as the releasing edge 9E that releases paint in a tangential direction at rotating.

On the other hand, a disk-shaped hub member 9F is provided inside the rotary atomizing head 9 to be positioned in the deep part of the inner peripheral surface 9D. The hub member 9F smoothly introduces the paint supplied from the feed tube 8 to the inner peripheral surface 9D. The rotary atomizing head 9 is further provided with an annular partition wall 9G in a position in rear of the hub member 9F and in a front side of the female screw 9B. The annular partition wall 9G forms to surround a front end part of the feed tube 8 with a slight clearance to form a paint reservoir 9H.

The rotary atomizing head 9 thus formed, when paint is supplied thereto from the feed tube 8 in a state of being rotated at high speeds by the air motor 3, sprays the paint as countless paint particles that are micronized by a centrifugal force from the releasing edge 9E through the paint reservoir 9H, the hub member 9F, and the inner peripheral surface 9D (paint thin film surface).

Next, an explanation will be made of the configuration of the shaping air ring 10 that is a characteristic part of the present invention.

Figure 3:
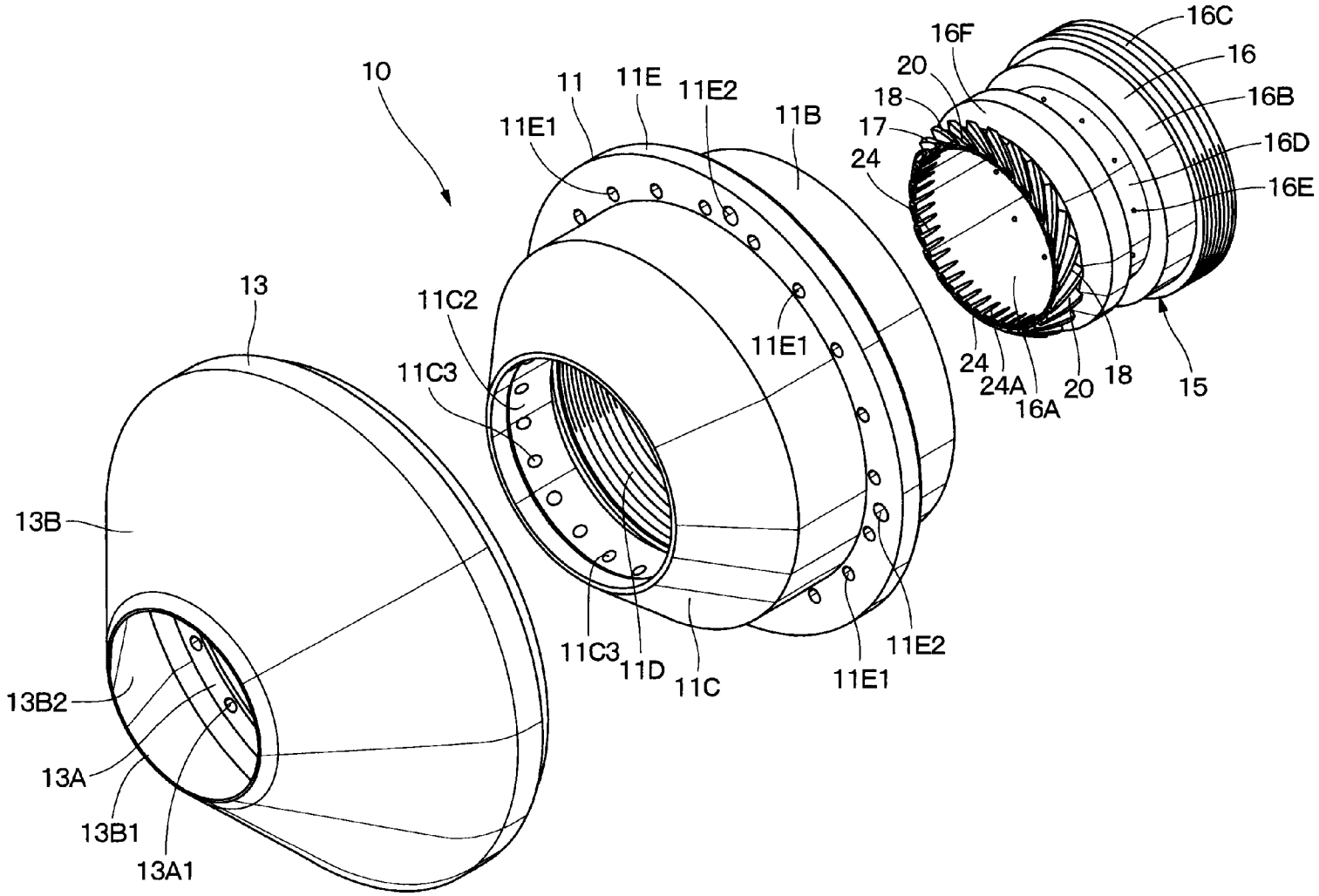
FIG. 3 is an exploded perspective view showing a shaping air ring in a state where a body, a cover and a nozzle are exploded.
Figure 4:
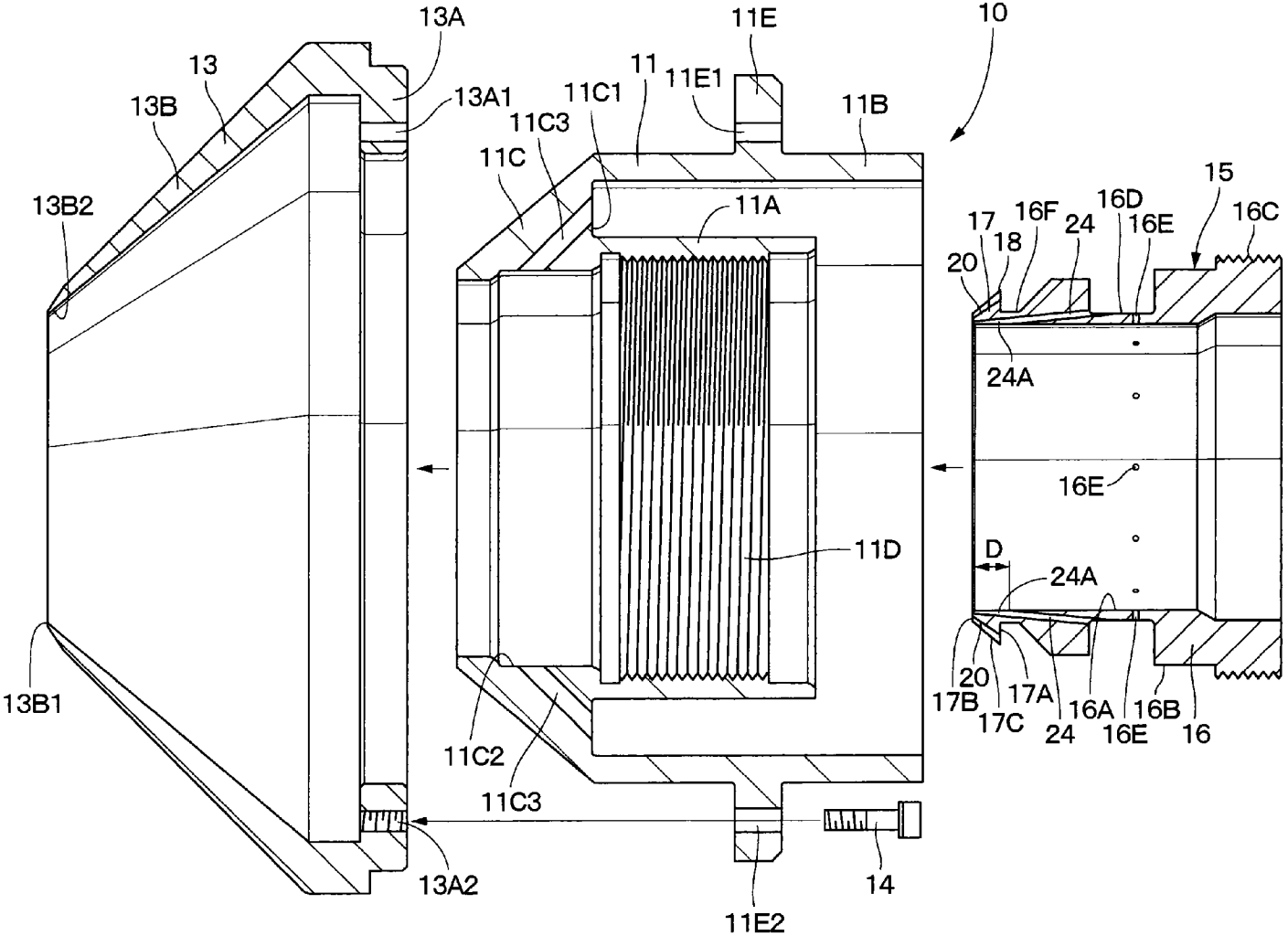
FIG. 4 is an exploded sectional view showing the shaping air ring in a state where the body, the cover and the nozzle are exploded.
Figure 5:
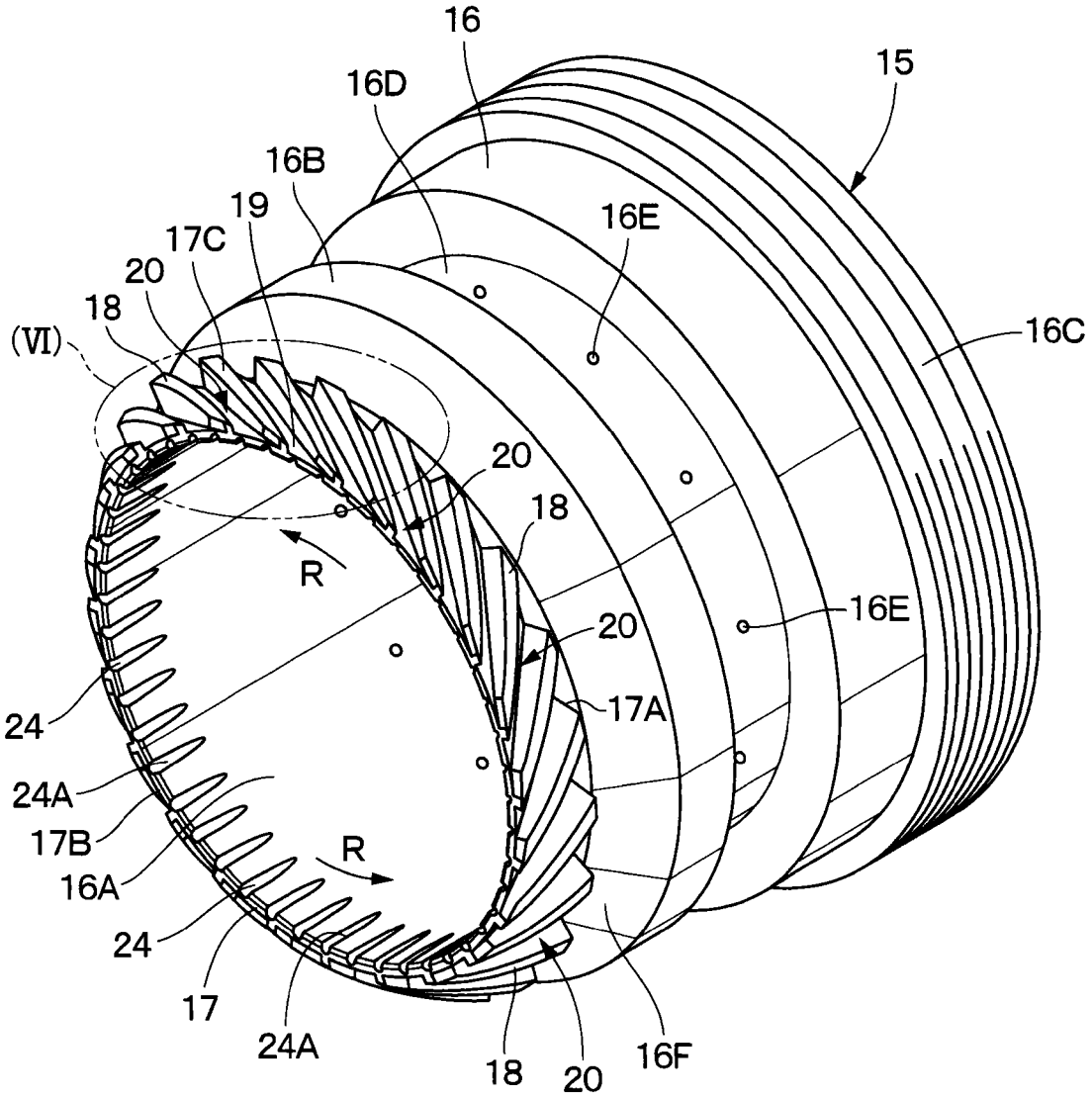
FIG. 5 is an enlarged perspective view showing the nozzle as a single body.
Figure 6:
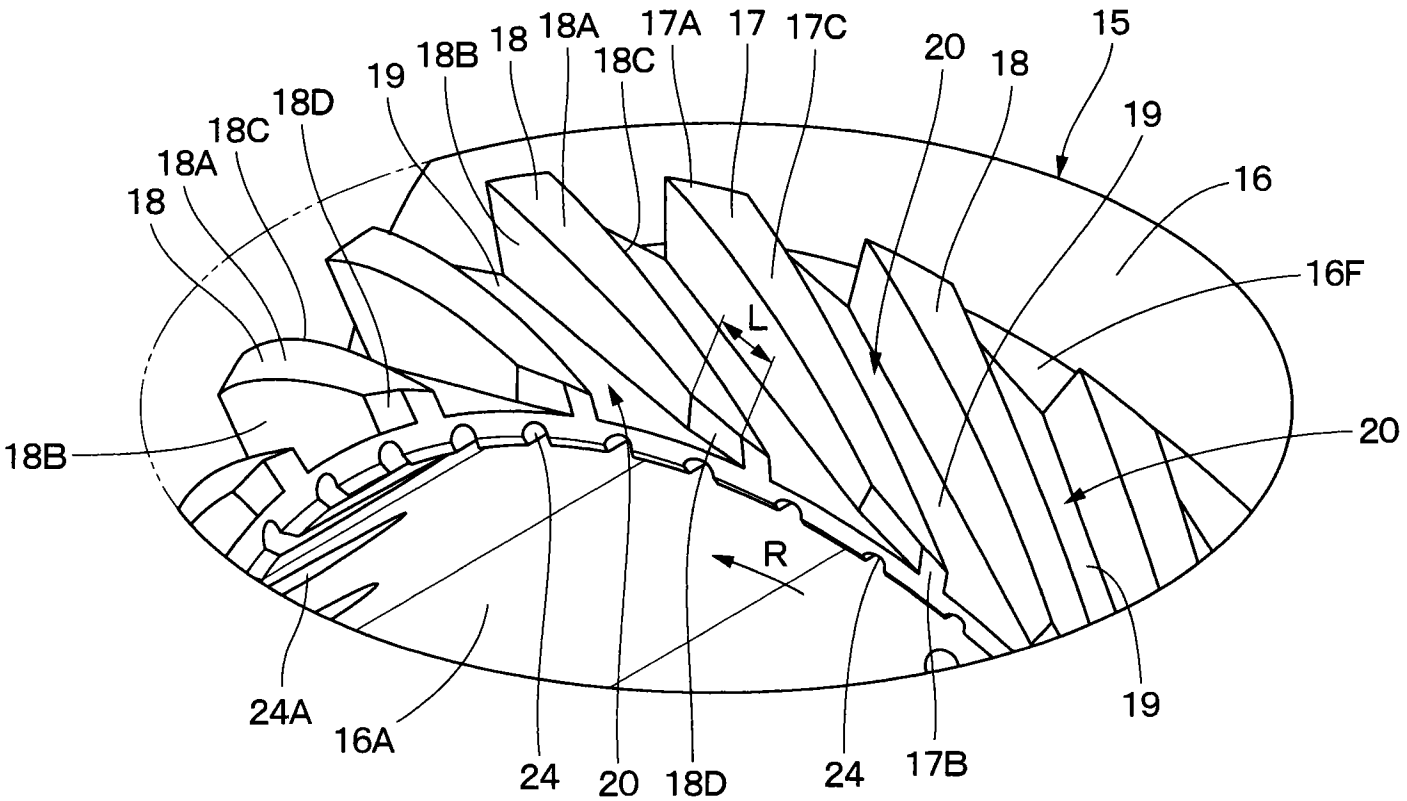
FIG. 6 is a partially enlarged sectional view showing (VI) part in FIG. 5.
Figure 7:
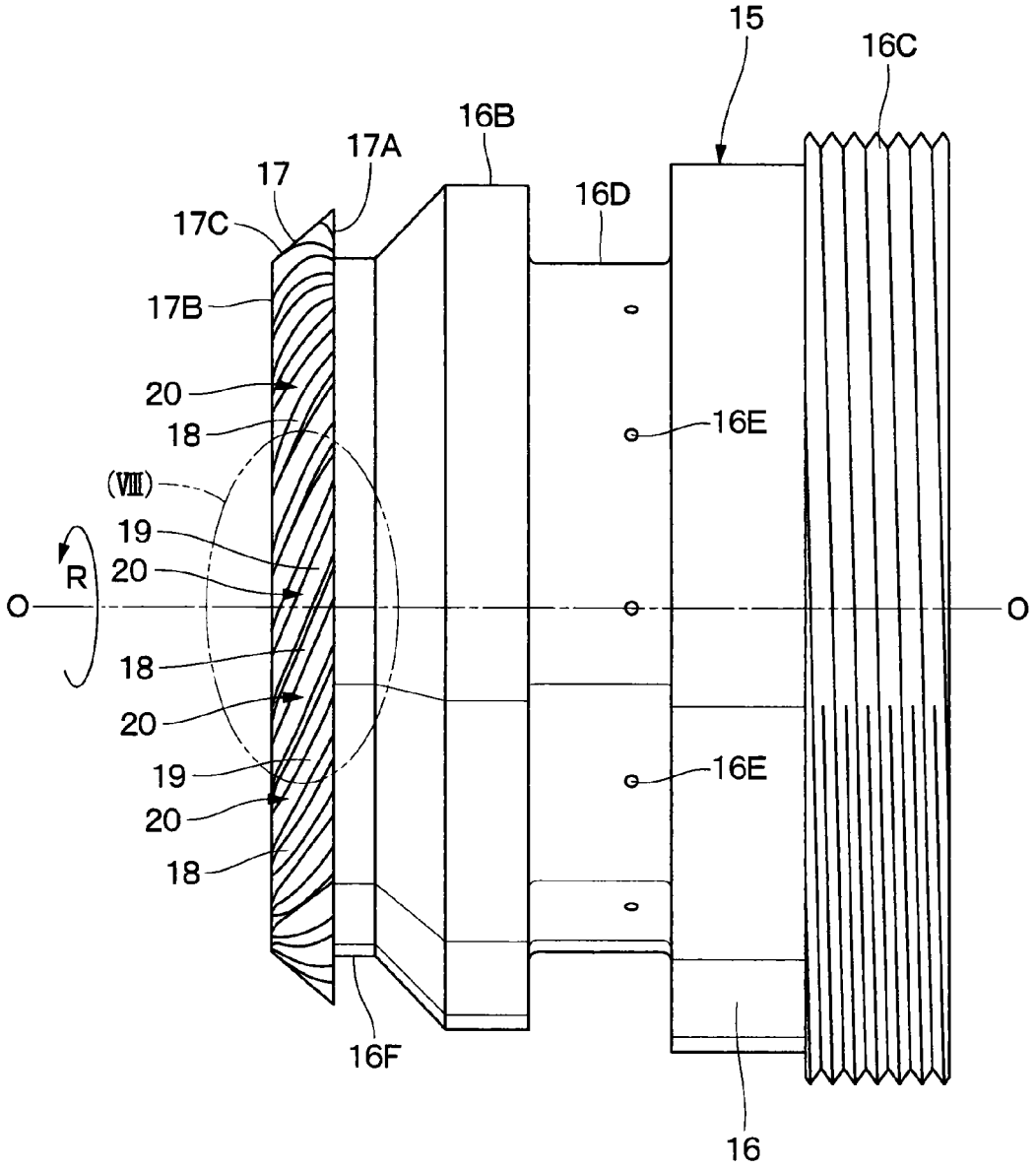
FIG. 7 is an enlarged side view showing the nozzle as a single body.

That is, the shaping air ring 10 is provided in a front side of the rotary atomizing head type coating machine 1. The shaping air ring 10 is disposed in the outer periphery of the rotary atomizing head 9 such that a front end thereof is positioned closer to the backward than the releasing edge 9E of the rotary atomizing head 9. The shaping air ring 10 ejects shaping air from each of shaping air ejecting holes 23, 24 to be described later to micronize paint sprayed from the releasing edge 9E of the rotary atomizing head 9 and adjust a spray pattern of the paint to a desired size and shape. As shown in FIG. 3 and FIG. 4, the shaping air ring 10 includes the body 11, the cover 13, the nozzle 15, the first shaping air ejecting hole 23 and the second shaping air ejecting hole 24, which will be described later.

The body 11 forms a main body of the shaping air ring 10, and the body 11 is formed as a tubular body that is mounted on a front side of the air motor 3. Here, the body 11 includes an inner tube 11A that is fitted on the small diameter tube 4B of the motor case 4 at the outer side, an outer tube 11B that is disposed coaxially around the inner tube 11A with an interval therefrom, and a conical annular body 11C that is provided in front of the inner tube 11A and the outer tube 11B. The female screw 11D is formed on an inner peripheral surface of the inner tube 11A, and the male screw 4E of the motor case 4 and a male screw 16C of a tubular body 16 forming the nozzle 15 are threaded into the female screw 11D.

The outer tube 11B is provided with a flange 11E that protrudes in a radial outside direction from an axial intermediate part. As shown in FIG. 3, the flange 11E is provided with a plurality of air passages 11E1 by intervals in the circumferential direction and a plurality of bolt insertion holes 11E2 by intervals in the circumferential direction. On the other hand, the conical annular body 11C is provided with a plurality of communication passages 11C3 that extend obliquely inside from a deep face part 11C1 positioned in the depth of a clearance between the inner tube 11A and the outer tube 11B to an inner peripheral surface 11C2. These communication passages 11C3 establish communication between a body-side annular space 12 and a nozzle-side annular space 21, which will be described later.

The body 11 can be mounted to an outer peripheral side of the inner tube 11A by threading the female screw 11D of the inner tube 11A into the male screw 4E of the motor case 4. At this time, the body 11 can define the body-side annular space 12 in a circular ring shape between the inner tube 11A, the outer tube 11B, the conical annular body 11C, and the large diameter tube 4A and the small diameter tube 4B of the motor case 4 by causing the outer tube 11B to make air-tight contact with a front surface of the large diameter tube 4A of the motor case 4. The body-side annular space 12 forms a part of a second air passage 28 to be described later.

The cover 13 is provided on an outer peripheral side of the body 11, and the cover 13 is formed as a conical tubular body having a diameter gradually smaller toward a front end thereof. The cover 13 is configured of an annular plate 13A that is positioned on an outer peripheral side of the outer tube 11B of the body 11 and faces the flange 11E, and a conical tube 13B having a diameter that is conically smaller from the annular plate 13A to a front end thereof. The annular plate 13A is provided with a plurality of air passages 13A1 corresponding to the air passages 11E1 provided in the flange 11E of the body 11, and a plurality of female screw holes 13A2 corresponding to the bolt insertion holes 11E2.

Figure 2:
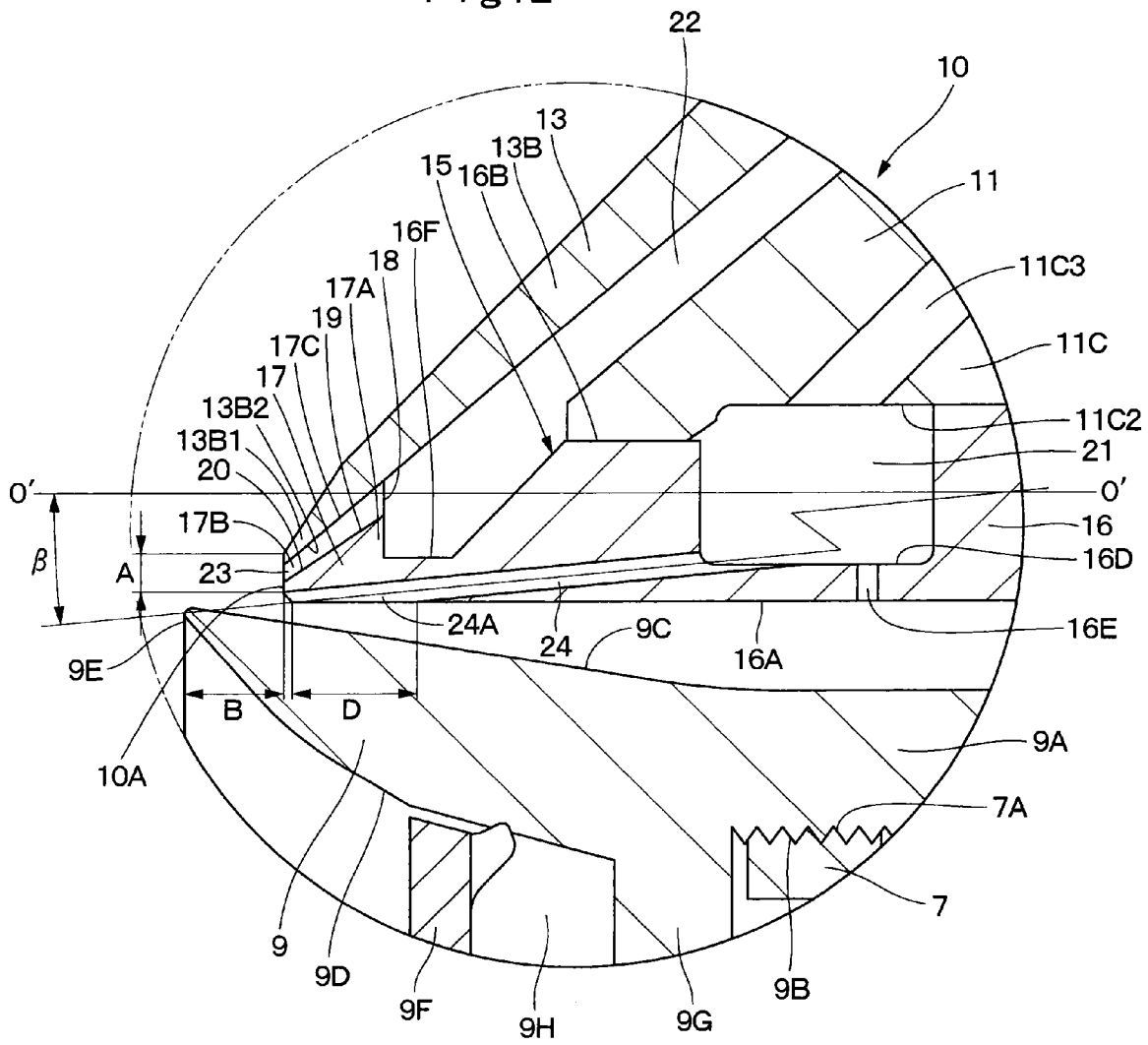
FIG. 2 is a partially enlarged cross sectional view showing (II) part in FIG. 1.

Here, as shown in FIG. 2, in the conical tube 13B forming the cover 13, an inner peripheral surface 13B2 of a front end 13B1 thereof forms a part of the first shaping air ejecting hole 23 to be described later. That is, the inner peripheral surface 13B2 of the conical tube 13B abuts on a forward tapered surface 17C of the conical protrusion 17 of the nozzle 15 in a state of making contact therewith without a clearance. As a result, the inner peripheral surface 13B2 forms the first shaping air ejecting hole 23 in cooperation with an inclined recessed groove 20.

The cover 13 thus formed is configured such that the annular plate 13A abuts on the flange 11E of the body 11 from a front side. In this state bolts 14 inserted in the bolt insertion holes 11E2 of the flange 11E are threaded into the female screw holes 13A2 of the annular plate 13A. Thereby, the cover 13 is mounted to be integral with the body 11. In this state, the air passage 11E1 of the flange 11E is communicated with the air passage 13A1 of the annular plate 13A to circulate compressed air from a housing-side annular space 27 to be described later to the cover-side annular space 22.

The nozzle 15 is provided on an inner peripheral side of the body 11, and a front end of the nozzle 15 extends to the same position with the front end 13B1 of the conical tube 13B of the cover 13. Here, the nozzle 15 is configured of the tubular body 16, the conical protrusion 17, protruding walls 18, the groove bottom faces 19 and the inclined recessed grooves 20 to be described later.

The tubular body 16 is configured as a base of the nozzle 15, and the tubular body 16 is formed as a cylindrical body axially extending. The tubular body 16 has an inner peripheral surface 16A having an inner diameter dimension larger than an outer diameter dimension of the rotary atomizing head 9, and an outer peripheral surface 16B facing the inner peripheral surface 11C2 of the conical annular body 11C of the body 11. In addition thereto, the tubular body 16 is provided with a male screw 16C that is positioned in a base end of the outer peripheral surface 16B and is threaded into the female screw 11D of the body 11. An annular groove 16D is provided in an axial intermediate part of the tubular body 16 to open in a radial outer direction.

On the other hand, a plurality of negative pressure preventing passages 16E are provided on an inner peripheral side of the tubular body 16 to open from a groove bottom of the annular groove 16D to the inner peripheral surface 16A. Each of the negative pressure preventing passages 16E supplies air to a space between the rotary atomizing head 9 and the shaping air ring 10 to prevent the space from becoming a negative pressure with rotation of the rotary atomizing head 9. In this case, a passage area of each of the negative pressure preventing passages 16E and the numbers of the negative pressure preventing passages 16E are set to the extent that an air supply amount thereof does not affect the shaping air ejected from the second shaping air ejecting holes 24 to be described later. Further, a front end of the tubular body 16 is reduced in diameter to be in a tapered shape to form a reduced diameter part 16F, and a front side part from the reduced diameter part 16F is configured as the conical protrusion 17 to be described later.

That is, the conical protrusion 17 is provided on an outer periphery of the front end part of the tubular body 16 (in a front side of the reduced diameter part 16F), protrudes in a radial outer direction, and is formed to be tapered forward. Specifically the conical protrusion 17 has a forward tapered surface 17C having a diameter dimension smaller toward a front end 17B from a base end 17A. The forward tapered surface 17C abuts on the inner peripheral surface 13B2 of the cover 13 in a state of making contact therewith without a clearance, and a part of the forward tapered surface 17C is configured as an outer wall surface 18A of each of the protruding walls 18 to be described later.

Figure 9:
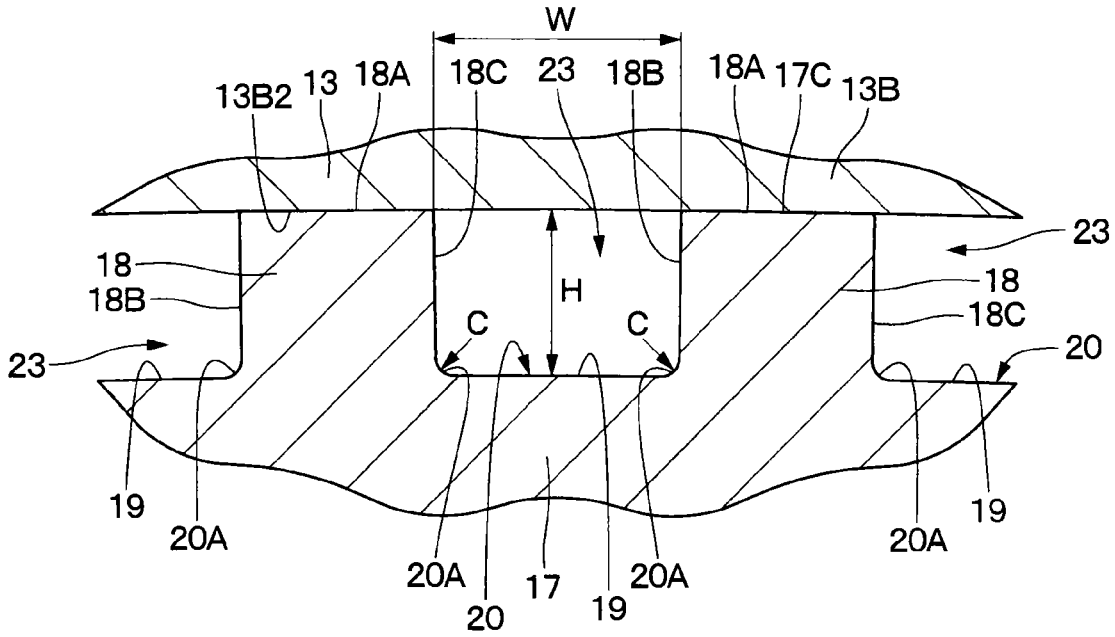
FIG. 9 is an enlarged sectional view showing the nozzle and the cover as viewed in a direction of arrows IX-IX in FIG. 8.

The protruding walls 18 are numerously provided to protrude by intervals on the entire periphery of the conical protrusion 17. Each of the protruding walls 18 is inclined in a direction reverse to a rotational direction R of the rotary atomizing head 9, and an inclination angle thereof is identical to an inclination angle α of the inclined recessed groove 20 to be described later. As shown in FIG. 9, each of the protruding walls 18 is formed as a protrusion in a square shape in section by an outer wall surface 18A that is positioned radially outward to abut on the inner peripheral surface 13B2 of the conical tube 13B of the cover 13, and a pair of side wall surfaces 18B, 18C rising down from both ends of the outer wall surface 18A in the width direction. A height dimension H of each of the protruding walls 18 between a front end of the respective side wall surfaces 18B, 18C and the groove bottom face 19 is set according to the following formula 1. A width dimension (interval dimension) W between front end parts of the respective side wall surfaces 18B, 18C is set according to the following formula 2.

$$0.4\ \text{mm} \le H \le 0.6\ \text{mm, preferably } 0.45\ \text{mm} \le H \le 0.55\ \text{mm} \quad \text{[Formula 1]}$$

$$0.6\ \text{mm} \le W \le 1.2\ \text{mm, preferably } 0.7\ \text{mm} \le W \le 1.0\ \text{mm} \quad \text{[Formula 2]}$$

On the other hand, the side wall surface 18B directed forward to face the outer peripheral surface 9C of the rotary atomizing head 9 among the pair of side wall surfaces 18B, 18C forming each of the protruding walls 18 is provided with a chamfered part 18D formed to be positioned in the front end. In the chamfered part 18D, the inclination angle α of the side wall surface 18B to be described later can be further increased in an opening side (front end side) by an inclination angle Δα by cutting a corner part of the front end of the side wall surface 18B (refer to FIG. 8). A length dimension L (refer to FIG. 6 and FIG. 8) of the chamfered part 18D is set according to the following formula 3.

$$0.3\ \text{mm} \le L \le 0.8\ \text{mm, preferably } 0.4\ \text{mm} \le L \le 0.6\ \text{mm} \quad \text{[Formula 3]}$$

Thereby, the first shaping air supplied from the air passage 25 can be ejected in a direction inclined at an inclination angle (α+Δα) larger than the inclination angle α. Accordingly, it is possible to apply the shaping air to the paint particles released from the rotary atomizing head 9 with precision to largely widen the spray pattern.

Here, the length dimension L of the aforementioned chamfered part 18D is appropriate for a case of using the rotary atomizing head 9 having a diameter dimension of approximately 30 mm. That is, the length dimension L is appropriately set according to a size of the rotary atomizing head 9, and is not limited to the above-mentioned value. Values indicated as follows may be likewise interpreted, and components herein are not limited in size to the described values.

The numerous groove bottom faces 19 each are formed between the pair of the opposing side wall surfaces 18B, 18C of the protruding walls 18 each. The groove bottom face 19 faces the inner peripheral surface 13B2 of the conical tube 13B of the cover 13 to be separated therefrom by the height dimension H. A width dimension W between front ends of the respective groove bottom faces 19 is the same dimension as the width dimension (interval dimension) W between the respective front ends of the aforementioned side wall surfaces 18B, 18C.

The inclined recessed grooves 20 are numerously provided on the forward tapered surface 17C of the conical protrusion 17 over the entire periphery. As shown in FIG. 6 to FIG. 9, the numerous inclined recessed grove 20 each are formed to be inclined in a direction reverse to the rotational direction of the rotary atomizing head 9. As shown in FIG. 9, the inclined recessed groove 20 is configured of the pair of the opposing side wall surfaces 18B, 18C of the protruding walls 18 adjacent to each other and the groove bottom face 19, and is formed as an angular groove having a height dimension (radial dimension) H and a width dimension (circumferential dimension) W. The inclined recessed groove 20 forms the first shaping air ejecting hole 23 to be described later with the inner peripheral surface 13B2 of the conical tube 13B in the cover 13 therebetween. In this case, for reducing an ejection amount of the first shaping air ejected from the first shaping air ejecting hole 23, it is required to reduce the passage area to speed up an ejection velocity of the first shaping air.

Therefore, the inclined recessed groove 20 is formed as a microscopic recessed groove having the height dimension H and the width dimension W at the front end part on the forward tapered surface 17C of the conical protrusion 17. In this case, since a processing method used for forming the inclined recessed groove 20 is grooving work, it is not an advanced processing work such as microscopic hole drilling, and the inclined recessed groove 20 can be simply and accurately processed. Further, since the inclined recessed groove 20 is exposed to an outside over the entire length, it is possible to easily and completely wash the attached paint only by rubbing it with a washing tool such as a brush.

In addition, in the inclined recessed groove 20, a corner part between each of the side wall surfaces 18B, 18C and the groove bottom face 19 is formed as an arc-shaped corner part 20A in an arc shape. A radius dimension C of the arc-shaped corner part 20A is set according to the following formula 4 corresponding to the height dimension H of each of the side wall surfaces 18B, 18C and the width dimension W of the groove bottom face 19.

$$0.01\ \text{mm} \le C \le 0.4\ \text{mm, preferably } 0.1\ \text{mm} \le C \le 0.2\ \text{mm} \quad \text{[Formula 4]}$$

Thereby, the arc-shaped corner part 20A can avoid stress concentration to increase a mechanical strength of the nozzle 15 to reduce the manufacturing costs. In addition, even when paint attaches to the inclined recessed groove 20, pigment, metallic powder and the like contained in the paint are difficult to deposit on the arc-shaped corner part 20A, and further, it is possible to easily wash the attached paint therefrom.

Figure 8:
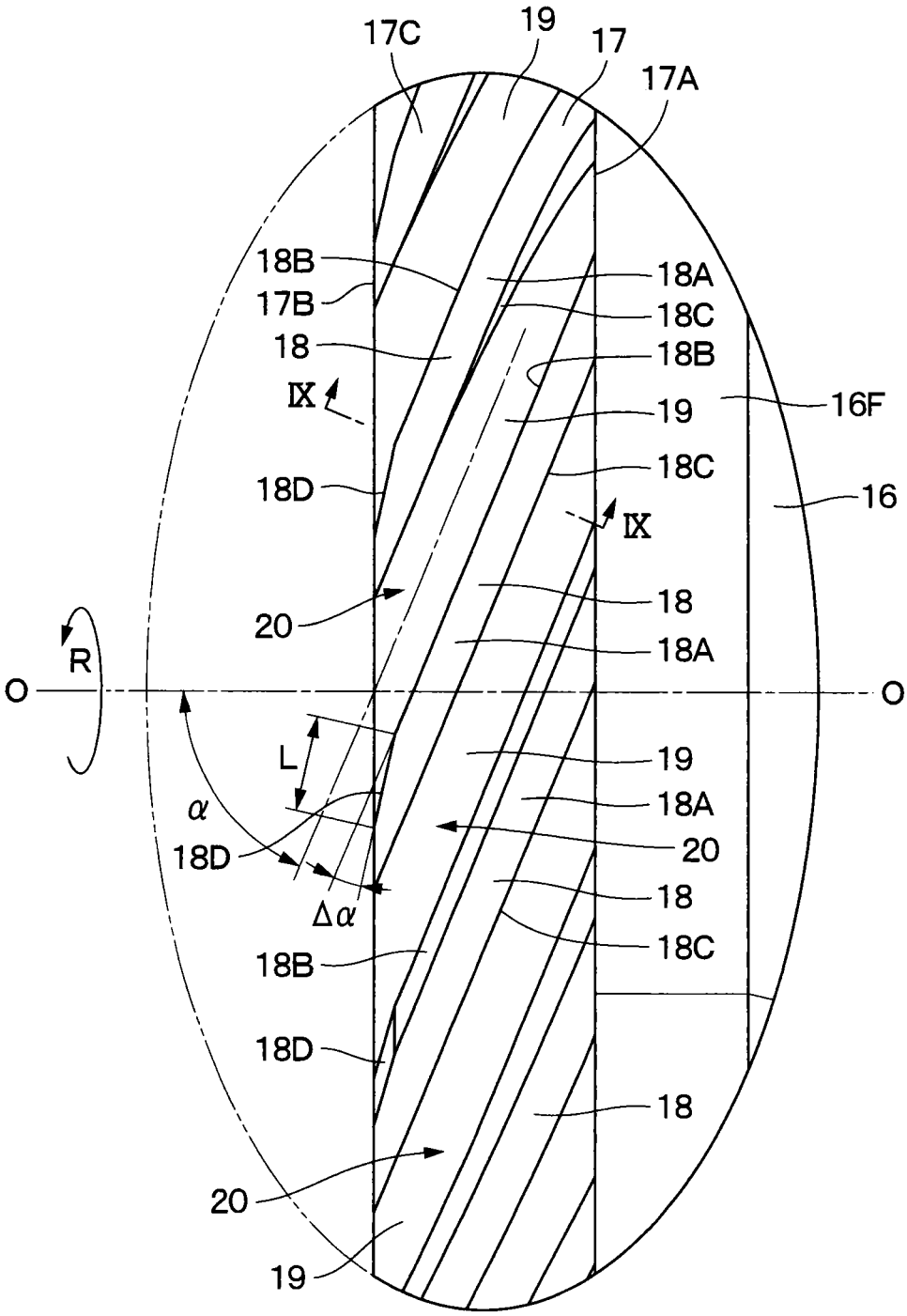
FIG. 8 is a partially enlarged sectional view showing (VIII) part in FIG. 7.

On the other hand, as shown in FIG. 8, the inclined recessed groove 20 is inclined at an angle α in a direction reverse to the rotational direction R of the rotary atomizing head 9 to the axis line O-O of the rotational shaft 7. This inclination angle α is set according to the following formula 5.

$$50\ \text{degrees} \le \alpha \le 80\ \text{degrees, preferably } 60\ \text{degrees} \le \alpha \le 70\ \text{degrees} \quad \text{[Formula 5]}$$

Thereby, the shaping air ejected from the inclined recessed groove 20 to be described later, that is, the first shaping air ejecting hole 23 can collide squarely with liquids of the paint flying in a tangential direction from the rotary atomizing head 9 to actively micronize the paint.

The nozzle 15 thus configured is inserted in the inner tube 11A of the body 11, and the male screw 16C of the tubular body 16 is threaded into the female screw 11D in the inner tube 11A. Thereby, the nozzle 15 can be mounted in the body 11. In a state where the nozzle 15 is mounted in the body 11, the nozzle-side annular space 21 can be defined between the annular groove 16D of the tubular body 16 and the inner peripheral surface 11C2 of the conical annular body 11C of the body 11. The nozzle-side annular space 21 is configured as a common passage for evenly supplying compressed air to the negative pressure preventing passage 16E of the tubular body 16 and the second shaping air ejecting hole 24. On the other hand, the cover-side annular space 22 in a forward tapered shape is defined between the body 11, the cover 13 and the nozzle 15. The cover-side annular space 22 is configured as a common passage for supplying compressed air to the first shaping air ejecting hole 23.

Further, the nozzle 15 is mounted in the body 11 from the rear side, thus making it possible to form the numerous first shaping air ejecting holes 23 to be described later between the respective inclined recessed grooves 20 and the conical tube 13B of the cover 13.

Here, as shown in FIG. 2, the first shaping air ejecting hole 23 and the second shaping air ejecting hole 24 are disposed to be radially closer to the front end of the shaping air ring 10. As a result, a front end surface of the shaping air ring 10 composed of the front end 13B1 of the conical tube 13B forming the cover 13 and the front end 17B of the conical protrusion 17 forming the nozzle 15 can be formed as the edge-shaped front end surface 10A having an area as small as possible. A radial dimension A of the edge-shaped front end surface 10A is set according to the following formula 6.

$$1\ \text{mm} \le A \le 6\ \text{mm, preferably } 3\ \text{mm} \le A \le 5\ \text{mm} \quad \text{[Formula 6]}$$

Further, the edge-shaped front end surface 10A of the shaping air ring 10 is disposed in a position backward away from the releasing edge 9E of the rotary atomizing head 9 by a length dimension B. The length dimension B by which the edge-shaped front end surface 10A is axially backward away from the releasing edge 9E is set according to the following formula 7.

$$2\ \text{mm} \le B \le 4\ \text{mm} \quad \text{[Formula 7]}$$

Thus, the edge-shaped front end surface 10A can make a surface area of a flat surface on which paint can attach as small as possible. Here, the negative pressure region is formed in the edge-shaped front end surface 10A by ejecting the shaping air from each of the shaping air ejecting holes 23, 24, and the sprayed paint is pulled to the edge-shaped front end surface 10A. However, since each of the shaping air ejecting holes 23, 24 is disposed around the edge-shaped front end surface 10A on which the paint can attach, the paint can be dispersed by the ejected air. This can suppress the paint from attaching on the edge-shaped front end surface 10A to cut down on the washing frequency and washing time.

Next, an explanation will be specifically made of the first shaping air ejecting holes 23 and the second shaping air ejecting holes 24.

The first shaping air ejecting holes 23 are numerously provided in the shaping air ring 10. The first shaping air ejecting holes 23 are formed as passages for circulating air between the cover-side annular space 22 and the edge-shaped front end surface 10A of the shaping air ring 10. The first shaping air ejecting hole 23 ejects the first shaping air toward the releasing edge 9E of the rotary atomizing head 9.

As shown in FIG. 9, the first shaping air ejecting hole 23 is formed by closing the inclined recessed groove 20 formed as an angular groove on the forward tapered surface 17C of the conical protrusion 17 by the inner peripheral surface 13B2 of the conical tube 13B of the cover 13. That is, the first shaping air ejecting hole 23 is formed as a hole (passage) in a square shape. Specifically, the first shaping air ejecting hole 23 is formed as a microscopic passage having a height dimension H and a width dimension W defined by a dimension of the front end of the inclined recessed groove 20. In addition, as shown in FIG. 8, the first shaping air ejecting hole 23 is inclined at an inclination angle $\alpha$ in a direction reverse to the rotational direction R of the rotary atomizing head 9 to the axis line O-O of the rotational shaft 7, and is further inclined by an inclination angle $\Delta\alpha$ at the chamfered part 18D. Therefore, the first shaping air ejecting hole 23 formed of the microscopic hole can cause the high-speed shaping air to collide squarely with the liquids of the paint flying in the tangential direction from the rotary atomizing head 9 even in a state where a flow amount of the compressed air to be supplied is small, micronizing the paint with a small flow amount of the compressed air.

Here, the first shaping air ejecting hole 23 opens to the edge-shape front end surface 10A of the shaping air ring 10. Accordingly, the first shaping air ejected as a swirl flow having the inclination angle ($\alpha+\Delta\alpha$) from the opening of the first shaping air ejecting hole 23 can be sprayed to the paint particles atomized from the releasing edge 9E of the rotary atomizing head 9 in a state where the swirl flow is sufficiently maintained. That is, the shaping air ejected with directivity from the first shaping air ejecting holes 23 each can efficiently micronize the paint particles, and can improve controllability of the spray pattern.

The second shaping air ejecting holes 24 are numerously provided in the shaping air ring 10 to be positioned in the inner peripheral side of the first shaping air ejecting hole 23. The second shaping air ejecting holes 24 are formed as passages for circulating air between the nozzle-side annular space 21 and the edge-shaped front end surface 10A of the shaping air ring 10. The second shaping air ejecting hole 24 ejects the second shaping air along the outer peripheral surface 9C of the rotary atomizing head 9.

As shown in FIG. 2, the second shaping air ejecting hole 24 is disposed in a direction to the front end of the shaping air ring 10 to be inclined radially inside at an inclination angle $\beta$ to a straight line O'-O' in parallel to the axis line O-O of the rotational shaft 7. The inclination angle $\beta$ is set according to the following formula 8.

$$1\ \text{degree} \le \beta \le 12\ \text{degrees, preferably } 5\ \text{degrees} \le \beta \le 10\ \text{degrees} \quad \text{[Formula 8]}$$

Therefore, as shown in FIG. 2 and FIG. 4, the front end of the second shaping air ejecting hole 24 opens as an elongated hole 24A in an oblong shape axially having a length dimension D to the inner peripheral surface 16A of the tubular body 16 of the nozzle 15. Thus the second shaping air ejecting hole 24 does not require a flat surface in the opening position by forming the front end of the second shaping air ejecting hole 24 as the elongated hole 24A. Therefore, the front end surface of the shaping air ring 10 can be formed as the edge-shaped front end surface 10A having a small radial width dimension. Further, the elongated hole 24A causes the wash fluid to efficiently flow into the second shaping air ejecting hole 24 to easily wash the paint attached to the second shaping air ejecting hole 24.

The second shaping air ejecting hole 24 can form complex shaping air in cooperation with the first shaping air ejecting hole 23. It is possible to furthermore perform the micronization of the paint particles and the improvement on the controllability of the spray pattern with this complex shaping air.

It should be noted that, as shown in FIG. 1, the first air passage 25 is provided for supplying the compressed air to the first shaping air ejecting hole 23. The first air passage 25 is configured of an inlet passage 26 provided on the outer peripheral side of the main housing body 2A of the housing 2, a housing-side annular space 27 defined between the housing 2, the air motor 3 and the shaping air ring 10, an air passage 11E1 provided in the flange 11E of the body 11, an air passage 13A1 provided in the annular plate 13A of the cover 13 and the cover-side annular space 22. The inlet passage 26 is connected via various lines to an air compressor as a pressure source and the like (none of them are shown).

The second air passage 28 is provided for supplying the compressed air to the second shaping air ejecting hole 24. The second air passage 28 is configured of an inlet passage 29 provided in a radial intermediate position of the main housing body 2A of the housing 2, a motor case-inside passage 30 provided in the motor case 4 of the air motor 3 to axially extend therein, the body-side annular space 12, the communication passages 11C3 of the conical annular body 11C of the body 11 and the nozzle-side annular space 21. The inlet passage 29 is connected via various lines to the air compressor and the like as similar to the aforementioned inlet passage 26.

The rotary atomizing head type coating machine 1 according to the present embodiment has the configuration as described above, and next, an explanation will be made of an operation of the rotary atomizing head type coating machine 1 at the time of performing a coating work using it.

The bearing air is supplied to the thrust air bearings 5B, 5C and the radial air bearing 6 of the air motor 3 to rotatably support the turbine 5 and the rotational shaft 7. On the other hand, the turbine air is supplied to the turbine 5 in the air motor 3 to rotate the rotational shaft 7. Therefore, the rotary atomizing head 9 is rotated together with the rotational shaft 7 at high speeds. In this state, the paint selected in the color changing valve device is supplied to the rotary atomizing head 9 from the paint passage in the feed tube 8, and thereby, the paint can be sprayed as paint particles from the rotary atomizing head 9.

In this case, the rotary atomizing head 9 is formed, for example, by using a metallic material having conductivity such as an aluminum alloy or a resin material a surface of which is subjected to conductive work. On the other hand, a coating factory is equipped with a high voltage generator (notshown) that increases a commercial power source to high voltages, for example, −60 to −150 kV. Therefore, for performing a coating work, high voltages that are output from the high voltage generator are applied to the feed tube 8, the rotary atomizing head 9 and the like. As a result, it is possible to charge the paint particles sprayed from the rotary atomizing head 9 with the high voltages.

In this way, since the high voltage is applied to the paint particles sprayed from the rotary atomizing head 9 by the high voltage generator, the paint particle charged with the high voltage flies toward a coating object that is connected to earth, thus making it possible to efficiently perform the coating thereon.

On the other hand, at the time of spraying paint from the rotary atomizing head 9, shaping air is separately ejected from the first shaping air ejecting holes 23 and the second shaping air ejecting holes 24 in the shaping air ring 10 respectively for micronization of the spray paint and adjustment of the spray pattern.

First, in a case of ejecting the first shaping air, the compressed air is supplied through the first air passage 25 to eject the shaping air from each of the first shaping air ejecting holes 23. Since the first shaping air ejecting holes 23 open to be inclined in the direction reverse to the rotational direction R of the rotary atomizing head 9 at this time, the shaping air can collide squarely with liquids of the paint flying in the tangential direction from the rotary atomizing head 9 to micronize the paint.

On the other hand, in a case of ejecting the second shaping air, compressed air is supplied through the second air passage 28, and the shaping air is ejected from each of the second shaping air ejecting holes 24. Since the second shaping air ejecting holes 24 open to be inclined radially inside toward the front end at this time, the shaping air can be supplied toward the outer peripheral surface 9C close to the releasing edge 9E of the rotary atomizing head 9. Therefore, the second shaping air ejecting holes 24 can perform acceleration of the micronization of the paint and efficient control of the spray pattern in cooperation with the first shaping air ejecting holes 23.

In this way, according to the present embodiment, the shaping air ring 10 is configured of three members including the body 11 that is formed in a tubular shape and is mounted to the front side position of the air motor 3, the conical cover 13 that is provided on the outer peripheral side of the body 11 and a diameter of which is reduced to be smaller toward the front end thereof, and the nozzle 15 that is provided on the inner peripheral side of the body 11 and the front end of which extends to the same position with the front end of the cover 13.

Further, the nozzle 15 has the front end provided with the forward tapered conical protrusion 17 that abuts on the inner peripheral surface 13B2 of the conical tube 13B in the cover 13 in a state of making contact therewith without a clearance. The conical protrusion 17 has the forward tapered surface 17C provided with the numerous inclined recessed grooves 20 over its entire periphery that are inclined in the direction reverse to the rotational direction R of the rotary atomizing head 9. On the other hand, the first shaping air ejecting hole 23 is formed between each of the inclined recessed grooves 20 and the inner peripheral surface 13B2 of the conical tube 13B in the cover 13 to eject the shaping air toward the releasing edge 9E of the rotary atomizing head 9. Further, the tubular body 16 of the nozzle 15 is provided with the second shaping air ejecting holes 24 to eject the shaping air along the outer peripheral surface 9C of the rotary atomizing head 9.

Accordingly, since the first shaping air ejecting holes 23 open to be inclined in the direction reverse to the rotational direction R of the rotary atomizing head 9, the shaping air can collide squarely with liquids of the paint flying in the tangential direction from the rotary atomizing head 9 to micronize the paint. Further, the first shaping air ejecting hole 23 can be formed using not unworkable hole drilling but easy-to-work grooving. Therefore, the first shaping air ejecting hole 23 having the small passage area can be formed in an easy work and further, it is possible to perform a reduction in use amount of the compressed air and simplification of the cleaning work due to the grooved shaping air ejecting hole.

In addition, since the conical protrusion 17 in the front end of the nozzle 15 is disposed in the same position with the front end of the cover 13, the first shaping air ejecting holes 23 numerously provided can be respectively opened independently on the edge-shaped front end surface 10A of the shaping air ring 10. Therefore, the shaping air ejected as the swirl flow from each of the first shaping air ejecting holes 23 can be splashed on the paint particles sprayed from the releasing edge 9E of the rotary atomizing head 9 in a state of sufficiently holding the swirl flow (directivity of a swirl direction).

As a result, the first shaping air ejecting hole 23 can be formed as the microscopic hole that is easy to wash by using the inclined recessed groove 20. In addition thereto, since the swirl direction of the shaping air has the directivity, it is possible to accelerate the micronization of the paint particles and improve the controllability of the spray pattern. On the other hand, since the second shaping air ejecting hole 24 is provided on the inner peripheral surface 16A of the tubular body 16 of the nozzle 15, the second shaping air ejecting hole 24 can form complex shaping air in cooperation with the first shaping air ejecting hole 23. Therefore, use of the complex shaping air can furthermore micronize the paint to improve the controllability of the spray pattern.

Since each of the first shaping air ejecting holes 23 is inclined in the direction reverse to the rotational direction R of the rotary atomizing head 9, it is possible to cause the first shaping air to effectively collide squarely with the paint particles released in the tangential direction from the releasing edge 9E of the rotary atomizing head 9 to micronize the paint and enlarge the spray pattern.

The chamfered part 18D is provided in the front end of the side wall surface 18B facing the outer peripheral surface 9C of the rotary atomizing head 9 among the side wall surfaces 18B, 18C of the protruding wall 18. Therefore, the inclination angle $\Delta\alpha$ by the chamfered part 18D adds to the inclination angle $\alpha$ of the inclined recessed groove 20, and it is thus possible for the chamfered part 18D to increase the inclination angle of the side wall surface 18B as $\alpha+\Delta\alpha$. As a result, the first shaping air can accurately apply to the paint particles released in the tangential direction from the releasing edge 9E of the rotary atomizing head 9 to largely widen the spray pattern of the paint.

On the other hand, the second shaping air ejecting hole 24 opens to the inner peripheral surface 16A of the tubular body 16 as the elongated hole 24A having a large length dimension in an axial direction. Accordingly, the edge-shaped front end surface 10A of the shaping air ring 10 can be formed such that a radial width dimension thereof is made small. In addition, wash liquids are likely to be easily poured in the second shaping air ejecting hole 24 opened as the elongated hole 24A in an oblong shape, and the second shaping air ejecting hole 24 can be easily washed.

Since the first shaping air ejecting hole 23 and the second shaping air ejecting hole 24 are disposed to be radially close to each other in the shaping air ring 10, the front end surface of the shaping air ring 10 is formed as the edge-shaped front end surface 10A having an area made as small as possible. Therefore, in the front end of the shaping air ring 10 that is the closest to the spray paint, an area of the flat surface thereof to which the paint can attach can be made as small as possible. As a result, the attachment of the paint to the front end of the shaping air ring 10 can be prevented to cut down on the washing frequency and washing time.

Further, in each of the inclined recessed grooves 20, the corner part 20A between each of the groove bottom faces 19 and each of the respective side wall surface 18B, 18C of the protruding walls 18 is formed in the arc shape. Therefore, even when the paint enters into the first shaping air ejecting hole 23, in the arc-shaped corner part 20A the attached paint can be easily washed to perform the washing work in a short time.

It should be noted that the present embodiment is explained by taking the direct charging type electrostatic coating machine that directly applies high voltages to paint supplied to the rotary atomizing head 9 as an example of the rotary atomizing head type coating machine 1. However, the present invention is not limited thereto, and may be applied to, for example, an indirect charging type electrostatic coating machine in which that an external electrode is provided on an outer peripheral position of the rotary atomizing head 9 to discharge high voltages and the discharge from the external electrode allows the high voltage to be applied to paint particles sprayed from the rotary atomizing head 9. Further, the present invention may be applied to a non-electrostatic coating machine that performs coating without applying high voltages to paint.

The present embodiment exemplifies a case where the rotary atomizing head 9 has a diameter dimension of 30 mm at the releasing edge 9E. However, the rotary atomizing head 9 used in the present invention may be used in any size where the diameter dimension is within a range of 20 to 60 mm, for example.

DESCRIPTION OF REFERENCE NUMERALS

1: Rotary atomizing head type coating machine
2: Housing
3: Air motor
4: Motor case
5: Turbine
7: Rotational shaft
8: Feed tube
9: Rotary atomizing head
9C: Outer peripheral surface
9D, 13B2, 16A: Inner peripheral surface
9E: Releasing edge
10: Shaping air ring
10A: Edged-shaped front end surface
11: Body
13: Cover
13B: Conical tube
13B1, 17B: Front end
15: Nozzle
16: Tubular body
17: Conical protrusion
17C: Forward tapered surface
18: Protruding wall
18A: Outer wall surface
18B, 18C: Side wall surface
18D: Chamfered part
19: Groove bottom face
20: Inclined recessed groove
20A: Arc-shaped corner part
23: First shaping air ejecting hole
24: Second shaping air ejecting hole
24A: Elongated hole
O-O: Axis line of rotational shaft
R: Rotational direction of rotary atomizing head
$\alpha$: Inclination angle of inclined recessed groove
H: Height dimension of side wall surface
W: Width dimension of groove bottom face
L: Length dimension of chamfered part
$\Delta\alpha$: Inclination angle of chamfered part
C: Radius dimension of arc-shaped corner part
$\beta$: Inclination angle of second shaping air ejecting hole
A: Radial dimension of edge-shaped front end surface
D: Length dimension of elongated hole of Second shaping air ejecting hole

The invention claimed is:

1. A rotary atomizing head type coating machine comprising:

an air motor that uses compressed air as a power source;

a hollow rotational shaft that is rotatably supported by said air motor and a front end of which protrudes to a front side from said air motor;

a feed tube that extends to the front end of said rotational shaft through said rotational shaft to supply paint;

a rotary atomizing head that is mounted to the front end of said rotational shaft and includes an outer peripheral surface expanding in a cup shape to a front side, an inner peripheral surface for dispersing the paint supplied from said feed tube, and a releasing edge positioned in a front end of the rotary atomizing head to release the paint; and a shaping air ring that is disposed spaced apart from the outer peripheral surface of said rotary atomizing head, a front end of the shaping air ring is positioned a first distance from the front end of the rotational shaft while the front end of the rotary atomizing head is positioned a second distance from the front end of the rotational shaft such that the second distance is greater than the first distance, said shaping air ring including first shaping air ejecting holes that eject shaping air toward said releasing edge of said rotary atomizing head and second shaping air ejecting holes that eject shaping air along said outer peripheral surface of said rotary atomizing head, characterized in that:

said shaping air ring includes:

a body that is formed in a tubular shape and is mounted to a front side position of said air motor;

a conical cover that is provided on an outer peripheral side of said body and a diameter of which is reduced to be smaller toward a front end thereof; and a nozzle that is provided on an inner peripheral side of said body and a front end of which extends to the same position with the front end of said cover, wherein said nozzle has the front end provided with a tapered conical protrusion that abuts on an inner peripheral surface of said cover in contact therewith without a clearance, said conical protrusion has a forward tapered surface provided with numerous inclined recessed grooves over its entire periphery that are inclined in a direction reverse to a rotational direction of said rotary atomizing head, each first shaping air ejecting hole is formed between each of said inclined recessed grooves and said inner peripheral surface of said cover, and each second shaping air ejecting hole is provided on an inner peripheral surface of said nozzle.

2. The rotary atomizing head type coating machine according to claim 1, wherein said inclined recessed grooves respectively are formed of numerous protruding walls provided to protrude by intervals on the entire periphery of said conical protrusion to be inclined in the direction reverse to the rotational direction of said rotary atomizing head, and a groove bottom face is formed between each pair of opposing side wall surfaces of said protruding walls, and each of said side wall surfaces forming each of said protruding walls is provided with a chamfered part that is positioned in a front end of said conical protrusion to further increase an inclination angle ($\alpha$) of each of said side wall surfaces.

3. The rotary atomizing head type coating machine according to claim 1, wherein each second shaping air ejecting hole of said shaping air ring is formed to be inclined radially inside toward a front end of said conical protrusion, and each second shaping air ejecting hole is opened to said inner peripheral surface of said nozzle as an elongated hole having a length dimension long in an axis line direction of said rotational shaft.

4. The rotary atomizing head type coating machine according to claim 1, wherein each first shaping air ejecting hole and each second shaping air ejecting hole are disposed to be radially closer to each other toward the front end of said shaping air ring, and a front end surface of said shaping air ring composed of the front end of said cover and a front end of said conical protrusion is formed as an edge-shaped front end surface.

5. The rotary atomizing head type coating machine according to claim 1, wherein said inclined recessed grooves) respectively are formed of numerous protruding walls provided to protrude by intervals on the entire periphery of said conical protrusion to be inclined in the direction reverse to the rotational direction of said rotary atomizing head, and numerous a groove bottom face is formed between each pair of opposing side wall surfaces of said protruding walls, and each of said inclined recessed grooves is provided with a corner part that is provided between each of said groove bottom faces and each of said side wall surfaces of said protruding walls respectively to be formed in an arc shape.

6. The rotary atomizing head type coating machine according to claim 1, wherein an inclination angle ($\alpha$) of each of said inclined recessed grooves is set to 50 to 80 degrees to an axis line of said rotational shaft.

7. The rotary atomizing head type coating machine according to claim 1, wherein an inclination angle ($\beta$) of each second shaping air ejecting hole is set to 1 to 12 degrees to an axis line of said rotational shaft.

8. The rotary atomizing head type coating machine according to claim 2, wherein a length dimension of said chamfered part of each of said protruding walls is set to 0.3 to 0.8 mm.

9. The rotary atomizing head type coating machine according to claim 4, wherein a radial dimension of said edge-shaped front end surface in said shaping air ring is set to 1 to 6 mm.

10. The rotary atomizing head type coating machine according to claim 5, wherein a height dimension of each of said side wall surfaces in front ends of said protruding walls respectively is set to 0.4 to 0.6 mm, and a width dimension of each of said groove bottom faces is set to 0.6 to 1.2 mm.

* * * * *